US009474341B2

(12) United States Patent
Chou

(10) Patent No.: US 9,474,341 B2
(45) Date of Patent: Oct. 25, 2016

(54) CLAMPED TYPE COUPLING ELEMENT SLIDE FASTENER WITH THE STRUCTURE IMPERVIOUS TO FLUID

(71) Applicants: Chao-Mu Chou, Taipei (TW); Shiu-Yin Cheng, Taipei (TW)
(72) Inventor: Chao-Mu Chou, Taipei (TW)
(73) Assignees: Chao-Mu Chou, Taipei (TW); Shiu-Yin Cheng, Taipei (TW)

( * ) Notice: Subject to any disclaimer, the term of this patent is extended or adjusted under 35 U.S.C. 154(b) by 153 days.
(21) Appl. No.: 14/303,820
(22) Filed: Jun. 13, 2014
(65) Prior Publication Data
US 2014/0366337 A1 Dec. 18, 2014
(30) Foreign Application Priority Data
Jun. 18, 2013 (TW) ..... 102121570 A
(51) Int. Cl.
*A44B 19/32* (2006.01)
*A44B 19/24* (2006.01)
(52) U.S. Cl.
CPC ..... *A44B 19/32* (2013.01); *A44B 19/24* (2013.01); *Y10T 24/2514* (2015.01)
(58) Field of Classification Search
CPC ..... A44B 19/32; A44B 19/24; A44B 19/34
USPC ..... 24/389, 384
See application file for complete search history.

(56) References Cited

U.S. PATENT DOCUMENTS 2,422,249 A * 6/1947 Malluk ..... A43B 3/02 24/389
2,526,600 A * 10/1950 Bolten, Jr. ..... A44B 19/04 24/410
3,668,745 A * 6/1972 Krupp ..... A44B 19/32 24/389
3,825,978 A * 7/1974 Sakalys ..... A44B 19/04 24/405
3,914,827 A * 10/1975 Brown ..... A44B 19/32 24/389
3,924,305 A * 12/1975 Hamamura ..... A44B 19/32 24/389
4,580,321 A * 4/1986 Tanikawa ..... A44B 19/32 24/384
4,607,416 A * 8/1986 Tanikawa ..... A44B 19/32 24/384
4,641,400 A * 2/1987 Moreland ..... A63C 19/12 135/119
4,658,480 A * 4/1987 Morioka ..... A44B 19/04 24/384
4,724,586 A * 2/1988 Tsubokawa ..... A44B 19/32 24/384
4,765,038 A * 8/1988 Kasai ..... A44B 19/06 24/389
6,622,351 B2 * 9/2003 Takasawa ..... A44B 19/26 24/389
2004/0237266 A1 * 12/2004 Wang ..... A44B 19/32 24/389
2006/0282995 A1 * 12/2006 Liou ..... A44B 19/32 24/389
2007/0094852 A1 * 5/2007 Wang ..... A44B 19/32 24/389
2007/0137006 A1 * 6/2007 Mikuma ..... A44B 19/04 24/403
2008/0189918 A1 * 8/2008 Kusayama ..... A44B 19/32 24/389
2010/0125982 A1 * 5/2010 Chou ..... A44B 19/32 24/397
2012/0246886 A1 * 10/2012 Matsumoto ..... A44B 19/32 24/381
2013/0014355 A1 * 1/2013 Lee ..... A44B 19/32 24/389
2014/0130974 A1 * 5/2014 Chen ..... A44B 19/42 156/270
2014/0304954 A1 * 10/2014 La Rocca ..... A44B 19/08 24/389
2014/0359978 A1 * 12/2014 Wang ..... A44B 19/42 24/389
2014/0359979 A1 * 12/2014 Gonda ..... A44B 19/32 24/415
2014/0366336 A1 * 12/2014 Chung ..... A44B 19/32 24/389
2014/0366337 A1 * 12/2014 Chou ..... A44B 19/24 24/389
2015/0157096 A1 * 6/2015 Mikuma ..... A44B 19/32 24/389

* cited by examiner

*Primary Examiner* — Robert J Sandy
*Assistant Examiner* — Jason W San
(74) *Attorney, Agent, or Firm* — Guice Patents PLLC

(57) ABSTRACT

The present invention relates to a clamped type coupling element slide fastener with the structure impervious to fluid, including a pair of support tapes, two rows of coupling elements respectively clamped at the inner edge of a first surface and a second surface of each of the support tapes, at least one surface of the top and bottom surfaces of the two rows of the coupling elements is formed with a groove; and an impervious elastomeric member. The impervious elastomeric member is filled in the groove of the two rows of the coupling elements thereby forming a covering layer, and the impervious elastomeric member is filled in a slit between the two rows of coupling elements and the pair of support tapes and in a slit formed on another surface of the two rows of the coupling elements thereby respectively forming a slit filling part and an extending part.

18 Claims, 5 Drawing Sheets

CLAMPED TYPE COUPLING ELEMENT SLIDE FASTENER WITH THE STRUCTURE IMPERVIOUS TO FLUID

BACKGROUND OF THE INVENTION

1. Field of the Invention

The present invention relates to a slide fastener with the structure impervious to fluid, especially to a clamped type coupling element slide fastener with the structure impervious to fluid.

2. Description of Related Art

With respect to the status of the coupling element, a conventional waterproof slide fastener can be categorized into the single-side coupling element slide fastener and a clamped type coupling element slide fastener, the first one is the conventional nylon slide fastener, and the coupling element is a thick artificial mono-filament being heated for formation for forming as a spiral continuous coupling element then being sewed or woven for being combined on one surface at the inner edge of a support tape; the second one is the clamped type coupling element having various types of teeth, materials and process means for being combined with a support tape, e.g. a conventional metal slide fastener, a plastic molded slide fastener, a continuous teeth plastic molded slide fastener, a L-type nylon slide fastener, the characteristic is that the coupling elements are clamped with a sandwich-like means at the inner dual surfaces of the support tape, so each of the coupling elements is clamped on a first and a second surfaces at the inner edge of the support tape; wherein the coupling elements of the metal slide fastener are combined with the support tape with a riveting or punching means, and the coupling elements of the individual teeth plastic molded slide fastener are formed on the support tape through an injection molding means, and the continuous teeth plastic molded slide fastener and the L-type nylon slide fastener are combined with the support tape with a sewing means.

In the aforesaid waterproof clamped type coupling element slide fastener, the coupling elements and the support tape are symmetrically arranged, the symmetrical structure can prevent the transversal force from being increased because of leverage, so the central slit is prevented from being stretched due to the transversal force. The U.S. Pat. No. 7,181,810 has disclosed a conventional waterproof clamped type coupling element slide fastener, one layer of waterproof film is provided for covering the exterior of the clamped type coupling element and the support tape at the same surface for achieving the waterproof function; but in actual use, the waterproof film is located between two rigid units which are the coupling element and the slider, so the waterproof film would be continuously worn by the slider, especially the friction applied by the stop pin in the slider, the waterproof film is therefore worn out and damaged and the waterproof function is no longer provided.

In addition, the U.S. Pat. No. 2,746,113 and the U.S. Pat. No. 3,409,953 have disclosed that under the situation of the slide fastener being separated, a mold is utilized for enabling an impervious elastomeric member to be respectively covered at the exterior of the left and the right coupling elements, so when the slide fastener is coupled, the impervious elastomeric member would mutually squeeze for achieving the waterproof function. However, the impervious elastomeric member having a special shape would cause the slide fastener to be thicker and hardened, and a large friction force is generated inside the slider, so the arranging stability of the coupling elements inside the slider is altered, and a slider formed in a certain status is required for coupling the slide fastener, but the slider formed in a certain status often causes the arrangement of the coupling elements being poor and the coupling process not being smooth, thus the application of the waterproof slide fastener is very limited.

Moreover, the U.S. Pat. No. 2,557,163 has disclosed under the situation of two rows of coupling elements being separated, an impervious elastomeric member is respectively injection molded at the inner edge of a support tape, then the coupling elements are coupled for forming a waterproof slide fastener, during the impervious elastomeric member being injection molded, a space has to be reserved for accommodating the coupling elements, then the coupling elements are individually riveted, the above-mentioned process is very complicated so the application of the waterproof slide fastener is also very limited.

SUMMARY OF THE INVENTION

One primary objective of the present invention is to provide a clamped type coupling element slide fastener with the structure impervious to fluid, which can be provided with an advantage of preventing a fluid, e.g. water, from penetrating through the coupling elements, so the structure of the slide fastener can be simplified and softer, and the friction between an impervious elastomeric member and the slider can be avoided, so the smoothness of coupling and separating the slide fastener can be facilitated, the durability is ensured, and the appearance can be prettified.

For achieving said objective, one technical solution of the present invention is to provide a clamped type coupling element slide fastener with the structure impervious to fluid, which include: a pair of support tapes symmetrically arranged at the left and right and respectively formed with a first surface and a second surface; two rows of coupling elements respectively clamped at the inner edge of the first surface and the second surface of the pair of the support tapes, so the two rows of the coupling elements are enabled to be mutually coupled or separated, wherein at least one surface of the top and the bottom surfaces of the two rows of the coupling elements is formed with a groove; and an impervious elastomeric member made of a high polymer elastomer, the impervious elastomeric member is filled in the groove of the two rows of the coupling elements when the two rows of the coupling elements are in a coupled status thereby forming a covering layer, and the impervious elastomeric member is filled in a slit between the two rows of the coupling elements and the pair of the support tapes and in a slit formed on another surface of the two rows of the coupling elements thereby respectively forming a slit filling part and an extending part; through cutting the covering layer at the center of the two rows of the coupling elements, the slide fastener is able to be coupled or separated.

For achieving said objective, another technical solution of the present invention is to provide a clamped type coupling element slide fastener with the structure impervious to fluid, which include: a pair of support tapes symmetrically arranged at the left and right and respectively formed with a first surface and a second surface; two rows of coupling elements respectively clamped at the inner edge of the first surface and the second surface of the pair of the support tapes, so the two rows of the coupling elements are enabled to be mutually coupled or separated, wherein the top and the bottom surfaces of the two rows of the coupling elements are respectively formed with a groove; and an impervious elastomeric member made of a high polymer elastomer, the impervious elastomeric member is filled in the grooves of the two rows of the coupling elements when the two rows of the coupling elements are in a coupled status thereby respectively forming a covering layer on the top and the bottom surfaces, and the impervious elastomeric member is filled in a slit between the two rows of the coupling elements and the pair of the support tapes thereby forming a slit filling part, and the covering layers on the top and the bottom surfaces and the slit filling part are combined as one piece; through cutting the covering layers at the center of the two rows of the coupling elements, the slide fastener is able to be coupled or separated.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
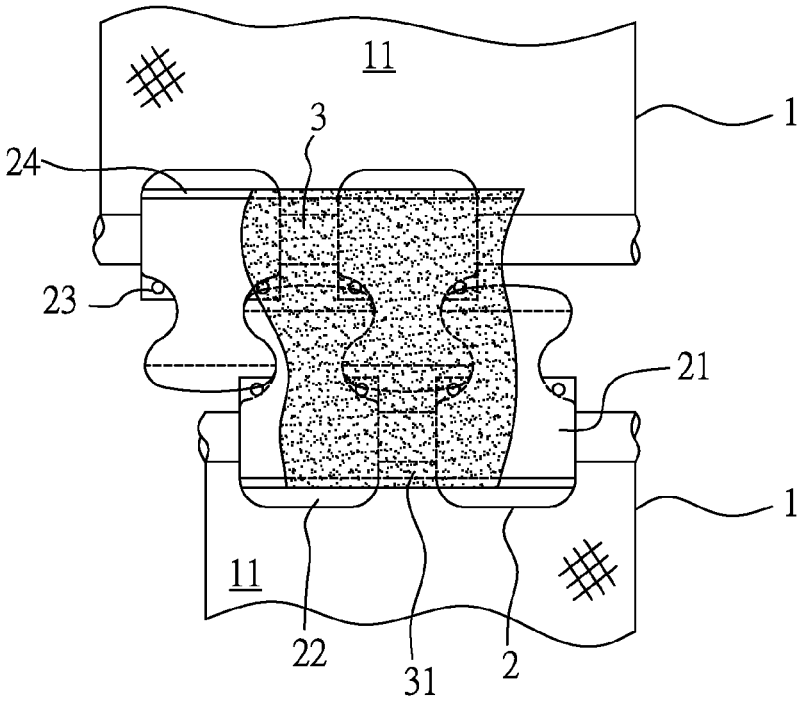
FIG. 1 is a schematic view illustrating the relative relation of each component of the clamped type coupling element slide fastener with the structure impervious to fluid according to a first embodiment of the present invention.
Figure 2:
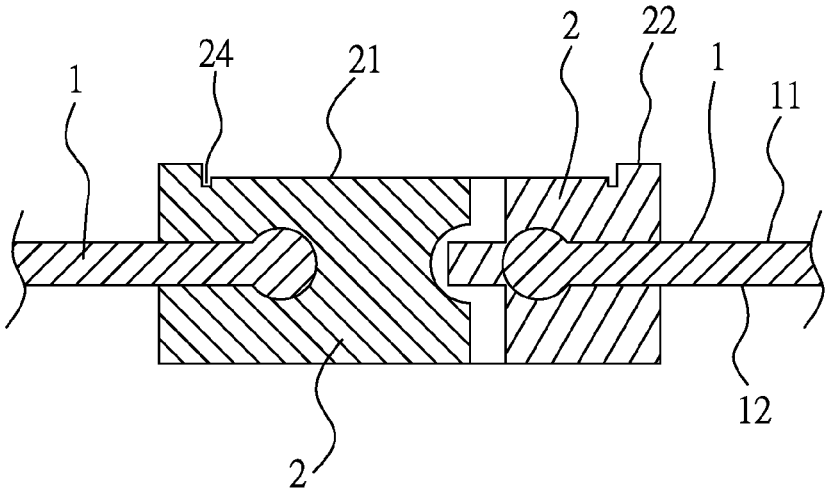
FIG. 2 is a cross sectional view illustrating the slide fastener yet not being filled in with an impervious elastomeric member.
Figure 3:
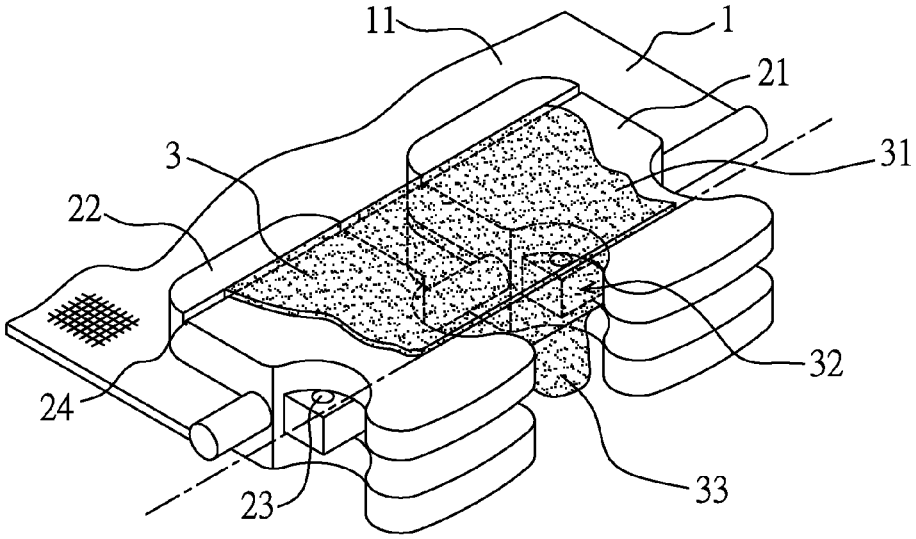
FIG. 3 is a perspective view illustrating a coupling element at single side of the clamped type coupling element slide fastener with the structure impervious to fluid according to the present invention.

Referring from FIG. 1 to FIG. 3, the present invention provides a clamped type coupling element slide fastener with the structure impervious to fluid which includes a pair of support tapes 1 symmetrically arranged at the left and right, two rows of coupling elements 2 parallel to each other and staggeringly arranged, and an impervious elastomeric member 3.

The pair of the support tapes 1 is formed through being knitted or woven, and an elastic construction, e.g. by the textured stretchy yarn, can be provided in the longitudinal or the latitudinal direction for providing a retractable and elastic function in the longitudinal or the latitudinal direction to the pair of the support tapes 1. Wherein, the support tapes 1 are respectively formed with a first surface 11 and a second surface 12, and each row of the coupling elements 2 are clamped at the inner edge of the first and the second surfaces 11, 12 of each of the support tapes 1 with a sandwich-like clamping means.

In actual practice, the coupling element 2 can be a plastic molded coupling element, a plastic clamped type continuous coupling element formed through being sewed for securing or a metal clamped type coupling element formed through being riveted for securing. As shown in FIG. 3, a plastic molded coupling element is adopted as the coupling element 2 for illustration and shall not be a limitation to the scope of the present invention. In fact, the coupling member 2 can be made of a metal or a non-metal material, e.g. being made of a material selected from POM, polyamide, polyester, acrylonitrile butadiene styrene (ABS), copper, aluminum or an alloy of zinc and aluminum; and one surface of the two rows of the coupling members 2 is formed with a groove 21 for receiving a covering layer 31 formed by the impervious elastomeric member 3.

The impervious elastomeric member 3 is made of a high polymer elastomer, e.g. thermoplastic polyurethane (TPU) or silicon, the technical characteristic of the impervious elastomeric member 3 is that the impervious elastomeric member 3 in a molten status is filled in for being covered in the groove 21 formed on one surface of the two rows of the coupling elements 2, the impervious elastomeric member 3 is be fully filled in the groove 21 thereby forming a covering layer 31 on one surface of the two rows of the coupling elements 2, and the impervious elastomeric member 3 is able to penetrate into an internal slit between the two rows of the coupling elements 2 and the pair of the support tapes 1 thereby forming a slit filling part 32, then the impervious elastomeric member 3 is further able to penetrate into a slit on another surface of the two rows of the coupling elements 2 thereby forming an extending part 33; when necessary, the location where the groove 21 being adjacent to an outer side 22 of each of the coupling elements 2 can be additionally formed with a concave channel 24, the channel 24 allows a cutting tool to be inserted for the purpose of cutting, so the excessive portion of the covering layer 31 at the outer side of the channel 24 can be removed thereby allowing the outer edge of the covering layer 31 to be aligned and unified, and the covering layer 31 is not protruded out of the outer side 22 of the coupling element thereby being prevented from being in contact with a slider. In addition, at least a hole 23 can be additionally formed at a proper location of each of the coupling elements 2, wherein the holes 23 are preferably to be formed in a conical status, so during the filling in process, the impervious elastomeric member 3 can also be filled in the holes 23 thereby providing an anchoring effect, and the combining strength between the impervious elastomeric member 3 and each of the coupling members 2 can be further enhanced. Accordingly, as shown in FIG. 1 and FIG. 3, the two rows of the staggeringly-arranged and separated coupling elements 2 are hidden below the covering layer 31.

After the impervious elastomeric member 3 is cooled and solidified, the center of the two rows of the coupling elements 2 of the slide fastener is cut by utilizing a cutting tool, so the covering layer 31, the slit filling part 32 and the extending part 33 of the impervious elastomeric member 3 are enabled to be naturally provided with the contour of each of the coupling elements 2, thereby forming a cover structure capable of fully and mutually sealing, so whenever the slide fastener is coupled or separated, the impervious elastomeric member 3 is able to tightly cover the corresponding coupling element 2, thereby providing a structure fully impervious to fluid. In addition, with the specially-designed contour of the coupling element 2, the extending part 33 of the impervious elastomeric member 3 formed on the other surface can be formed with a special shape. Moreover, in order to provide a waterproof effect to the pair of the support tapes 1, the slide fastener can be immersed in a water repellent agent then be heated for curing thereby forming a waterproof layer. As such, fluid is prevented from entering the interior of the slide fastener from the support tape 1.

Figure 4:
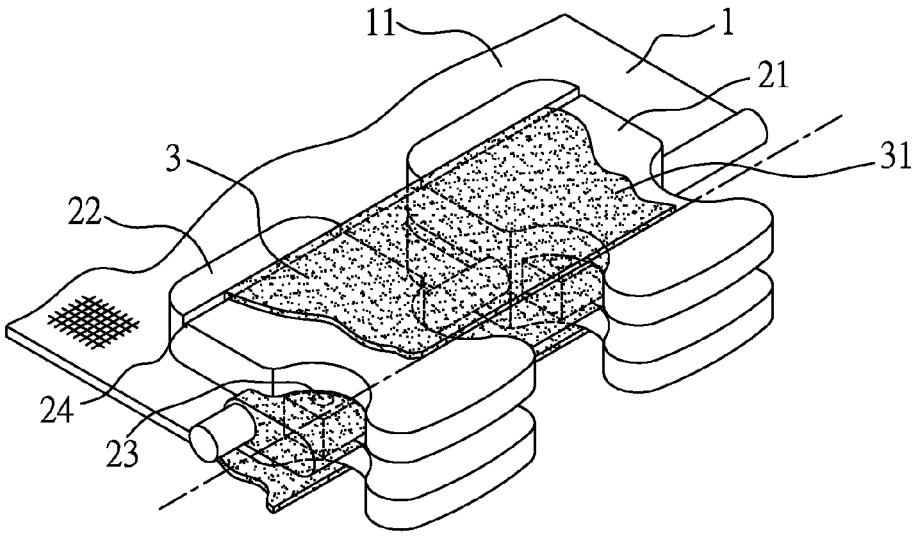
FIG. 4 is a perspective view illustrating the clamped type coupling element slide fastener with the structure impervious to fluid according to a second embodiment of the present invention.

Referring to FIG. 4, which is a perspective view illustrating the clamped type coupling element slide fastener with the structure impervious to fluid according to a second embodiment of the present invention. The clamped type coupling element 2 is a plastic molded coupling element, and the top and the bottom surfaces thereof are respectively formed with a groove 21; and with the above-mentioned filling in process, the impervious elastomeric member 3 in a molten status are respectively covered in the grooves 21 formed on the top and the bottom surfaces of the two rows of the coupling elements 2, thereby respectively forming a covering layer 31 on the top and the bottom surfaces, meanwhile the impervious elastomeric member 3 is able to be filled in a slit filling part 32 formed between the two rows of the coupling elements 2 and the pair of the support tapes 1, so the two covering layers 31 and the slit filling part 32 are able to be combined as one piece, and the impervious elastomeric member 3 is able to fully cover each row of the coupling elements 2 for increasing the combining strength of the impervious elastomeric member 3 and the coupling elements 2 and enhancing the impervious function.

Furthermore, the groove 21 of the clamped type coupling element 2 is served to receive the covering layer 31 of the impervious elastomeric member 3, and the height of the covering layer 31 is preferably to be not higher than the outer side 22 of the coupling element 2, so the impervious elastomeric member 3 can be prevented from being in contact with the interior of the slider, thereby reducing the friction, increasing the impervious capability and greatly enhancing the smoothness for the slide fastener to be coupled and separated.

Figure 5:
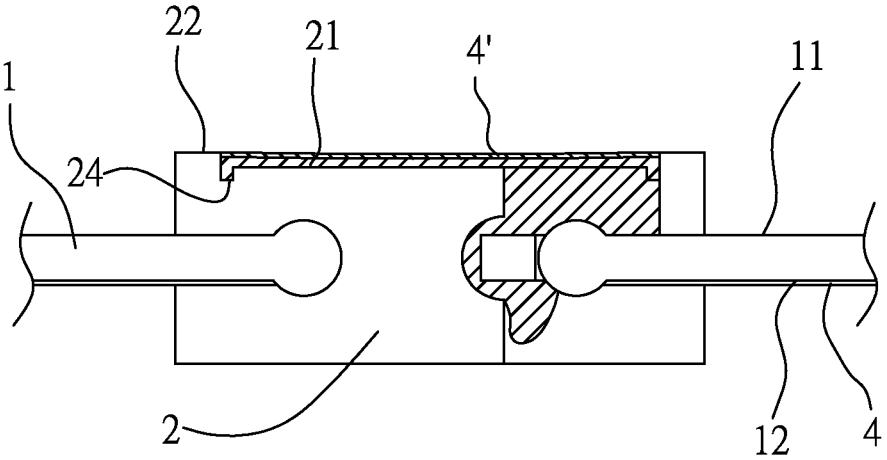
FIG. 5 is a cross sectional view illustrating the clamped type coupling element slide fastener with the structure impervious to fluid according to a third embodiment of the present invention.

Referring to FIG. 5, which is a cross sectional view illustrating the clamped type coupling element slide fastener with the structure impervious to fluid according to a third embodiment of the present invention. The pair of the support tapes 1 is formed with at least a surface, e.g. a second surface 12, which is firstly covered with a waterproof film 4, then provided with the plastic molded coupling element 2, and the impervious elastomeric member 3 in a molten status is covered in the groove 21 formed on at least one surface of the two rows of the coupling elements 2 thereby forming a covering layer 31, and the impervious elastomeric member 3 is continuously filled in an internal slit between the two rows of the coupling elements 2 and the pair of the support tapes 1 thereby forming a slit filling part 32, then the impervious elastomeric member 3 is further penetrated into a slit on another surface of the two rows of the coupling element 2 thereby forming an extending part 33; the top surface of the covering layer 31 is adhered with a waterproof film 4' made of different material and having a different appearance, thereby enhancing the waterproof capability, the decorating function and wearing resistance of the covering layer 31.

Wherein, the waterproof films 4, 4' are respectively formed as a double-layer structure, and an upper layer thereof is a film formed through a high molten temperature polymer elastomer, e.g. but not limited to polyurethane (PU) and a lower layer thereof is a thermosetting polymer elastic adhesive, e.g. reactive hot-melt polyurethane, adhered on at least one surface of the pair of the support tapes 1 and the surface of the covering layer 31.

Figure 6:
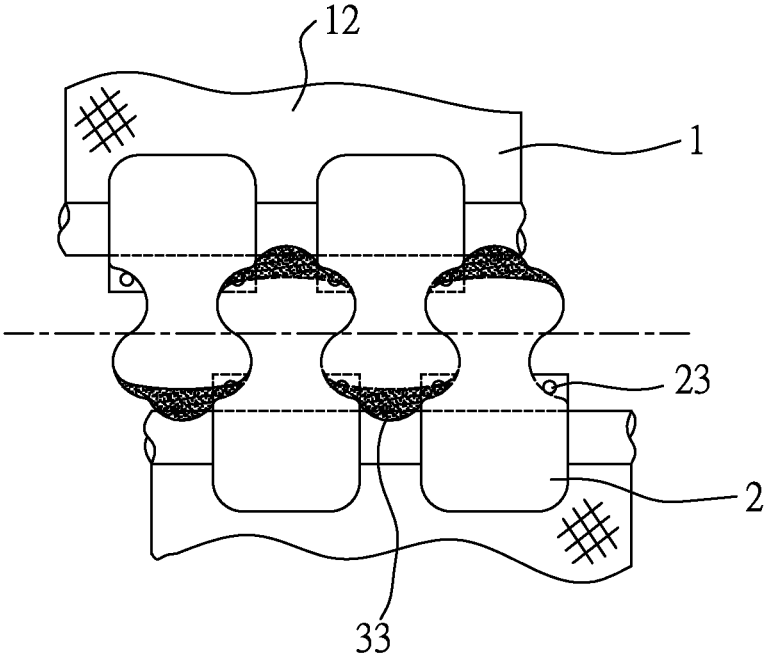
FIG. 6 is a schematic view illustrating the clamped type coupling element slide fastener with the structure impervious to fluid according to a fourth embodiment of the present invention.

Referring to FIG. 6, which is a schematic view illustrating the clamped type coupling element slide fastener with the structure impervious to fluid according to a fourth embodiment of the present invention. The clamped type coupling element 2 is a plastic molded coupling element and formed with at least a hole 23 at a proper location of each of the coupling elements 2, so the impervious elastomeric member 3 is able to be filled from the covering layer 31 into the holes 23 thereby providing an anchoring effect and enhancing the combining strength of the impervious elastomeric member 3 and the coupling elements 2. By predesigning a special contour for the coupling element 2, the extending part 33 of the impervious elastomeric member 3 on another surface can be formed with a special shape, thereby enhancing the combining strength of the impervious elastomeric member 3 and each row of the coupling elements 2 and providing a novel appearance to the slide fastener.

Figure 7:
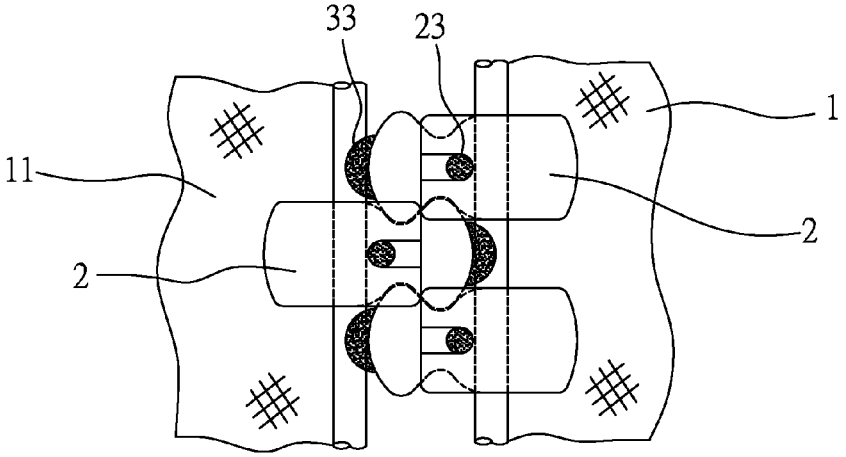
FIG. 7 is a schematic view illustrating the clamped type coupling element slide fastener with the structure impervious to fluid according to a fifth embodiment of the present invention.

Referring to FIG. 7, which is a schematic view illustrating the clamped type coupling element slide fastener with the structure impervious to fluid according to a fifth embodiment of the present invention. The two rows of the coupling elements 2 are coupling elements which are unsymmetrical coupling elements (as what has been disclosed in the U.S. Pat. No. 2,526,600), one surface thereof is formed with an arc-shaped neck part and an arc-shaped head part capable of mutually buckled, another surface thereof in substantially formed in a rectangular status, and at least a hole 23 is formed at a proper location of each of the coupling elements 2, thereby allowing the impervious elastomeric member 3 to be filled from the covering layer 31 into the holes 23 so as to provide an anchoring effect and enhance the combining strength of the impervious elastomeric member 3 and each row of the coupling elements 2; and with the rectangular appearance of each row of the coupling elements, the slide fastener is provided with a novel appearance. According to this embodiment, the above-mentioned waterproof layer, e.g. the water repellent agent or the waterproof film 4, 4', can also be provided for greatly enhancing the waterproof capability and providing a novel appearance to the slide fastener.

Figure 8:
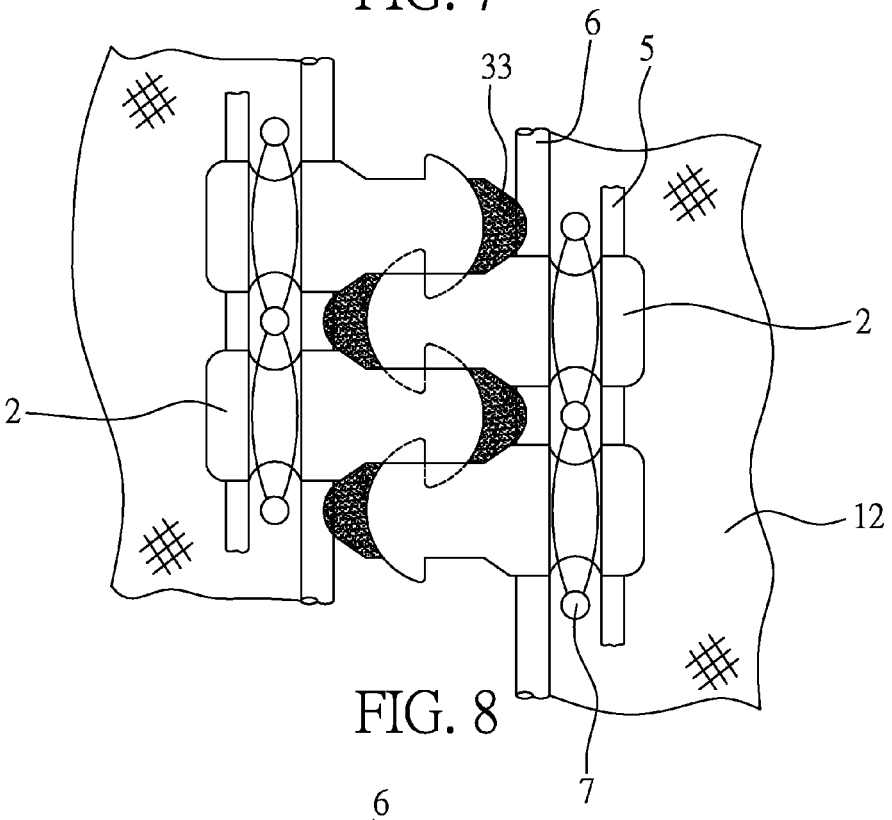
FIG. 8 is a schematic view illustrating the clamped type coupling element slide fastener with the structure impervious to fluid according to a sixth embodiment of the present invention.
Figure 9:
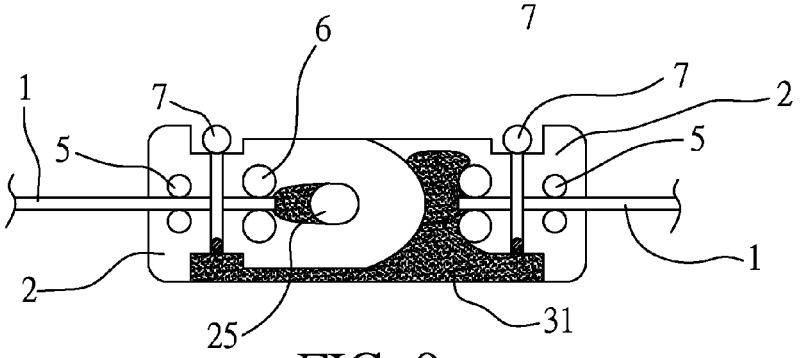
FIG. 9 is a cross sectional view illustrating the clamped type coupling element slide fastener with the structure impervious to fluid according to the sixth embodiment of the present invention.

Referring to FIG. 8 and FIG. 9, wherein FIG. 8 is a schematic view illustrating the clamped type coupling element slide fastener with the structure impervious to fluid according to a sixth embodiment of the present invention; and FIG. 9 is a cross sectional view illustrating the clamped type coupling element slide fastener with the structure impervious to fluid according to the sixth embodiment of the present invention. Wherein, molded continuous clamped type coupling elements are adopted, and the adjacent clamped type coupling elements 2 are embedded with at least a longitudinal string 6 thereby forming a row of continuous clamped type coupling elements 2. In addition, each row of the continuous clamped type coupling elements 2 can be additionally provided with a combination member 5 parallel to the longitudinal string 6 and made of the same material for increasing the arranging stability of each row of the continuous clamped type coupling elements 2. According to this embodiment, after the two rows of the continuous clamped type coupling elements 2 are stacked and staggered, seam 7 is used for sewing each row of the continuous clamped type coupling elements 2 at the inner edge of each of the support tapes 1, thereby forming an internal chamber 25 in each of the coupling elements 2. The impervious elastomeric member 3 is filled in for enabling the impervious elastomeric member 3 in a molten status to be covered in the groove 21 formed on at least one surface of the two rows of the coupling elements 2, thereby forming a covering layer 31, and the impervious elastomeric member 3 is continuously filled in an internal slit between the two rows of the coupling elements 2 and the pair of the support tapes 1 and in the internal chamber 25 thereby forming slit filling part 32, then the impervious elastomeric member 3 further penetrates into a slit on another surface of the two rows of the coupling element 2 thereby forming an extending part 33. Because the impervious elastomeric member 3 is filled in the internal chamber 25 for forming an anchoring effect, the combining strength of the impervious elastomeric member 3 and the coupling elements 2 and the waterproof capability are enhanced.

Figure 10:
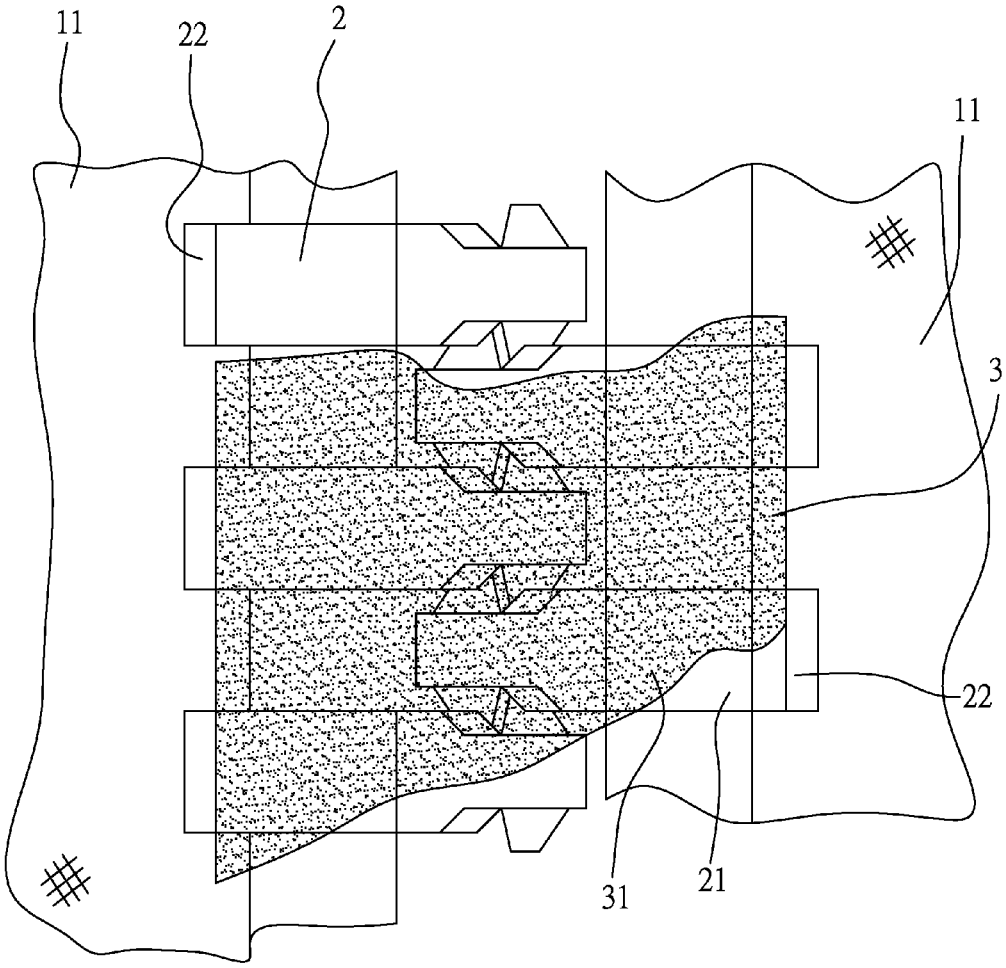
FIG. 10 is a schematic view illustrating the clamped type coupling element slide fastener with the structure impervious to fluid according to a seventh embodiment of the present invention.

Referring to FIG. 10, which is schematic view illustrating the clamped type coupling element slide fastener with the structure impervious to fluid according to a seventh embodiment of the present invention. The structure disclosed in the seventh embodiment is similar to the first embodiment, two rows of metal clamped type coupling elements 2 are adopted in this embodiment, and the two rows of the metal clamped type coupling elements 2 are respectively riveted on the first and the second surfaces 11, 12 at the inner edge of each of the support tapes 1; the top and the bottom surfaces of each row of the coupling elements 2 are respectively formed with a groove 21, the above-mentioned filling in means is processed for allowing the impervious elastomeric member 3 in a molten status to be respectively covered in the grooves 21 formed at the top and the bottom surfaces of the two rows of the coupling elements 2 thereby respectively forming a covering layer 31 on the top and the bottom surfaces, and the impervious elastomeric member 3 is continuously filled in a slit between the two rows of the coupling elements 2 and the pair of the support tapes 1 thereby forming an up/down connected slit filling part 32, so the impervious elastomeric member 3 is able to fully cover the coupling elements 2 thereby enhancing the combining strength of the impervious elastomeric member 3 and each row of the coupling elements 2 and also increasing the impervious function.

Based on what has been disclosed above, advantages achieved by the present invention are as following:

1. The coupling elements and the engaging point (the pivot) and the support tapes of the clamped type coupling element slide fastener provided by the present invention are aligned on a same imaginary force applying line, so the provided symmetrical structure solves a disadvantages of a conventional waterproof slide fastener being applied with a transversal force because of leverage, so the covering layer, the slit filling part and the extending part of the impervious elastomeric member formed in the groove of the two rows of the coupling elements are prevented from being stretched out due to the transversal force thereby enhancing the waterproof effect.
2. In the slide fastener provided by the present invention, a groove is formed at a proper location on one surface of each row of the coupling elements, so the covering layer, the slit filling part and the extending part of the impervious elastomeric member are enabled to be combined for forming as a continuous member so as to cover the coupling elements and fully fill the silts formed between the coupling elements, thereby preventing a fluid, e.g. water, from penetrating and preventing the slider from directly wearing the impervious elastomeric member, so the smoothness of coupling and separating the slide fastener can be facilitated, the durability is ensured, and the function of preventing fluid from penetrating is also provided.
3. In the slide fastener provided by the present invention, a groove is respectively formed at a proper location on the top and the bottom surfaces of each row of the coupling elements, so the impervious elastomeric member is able to cover the top and the bottom surfaces of each row of the coupling elements, the two covering layers are combined with the slit filling parts for forming a continuous impervious elastomeric member so as to cover the coupling elements and fully fill the silts formed between the coupling elements, thereby effectively increasing the function of preventing fluid from penetrating, and the smoothness of coupling and separating the slide fastener can be facilitated, and the durability is ensured. Especially, the covering layers formed on the top and the bottom surfaces can be provided with different colors so as to obtain a dual-color slider fastener, so the coloring application for the slide fastener can be freely designed.
4. According to the present invention, at least a hole is formed at a proper location of the two rows of the coupling elements, an anchoring effect can be provided after the impervious elastomeric member is filled in the holes, thereby enhancing the combining strength of the impervious elastomeric member and the coupling elements, and the function of preventing fluid from penetrating is provided, and the durability of the slide fastener is also ensured.
5. According to the present invention, the covering layer of the impervious elastomeric member can be additionally provided with a waterproof film; with the waterproof film having different functions, e.g. a patterned film or a light reflection film, the application, the decorating function and wearing resistance of the slide fastener can be increased.
6. According to the present invention, the support tape can be provided with a water repellent agent, or adhered with a waterproof film, thereby increasing the impervious function.
7. According to the present invention, the appearance of the coupling element can be designed to have a certain contour, e.g. an up/down unsymmetrical coupling elements, so the impervious elastomeric member can be more easily penetrated into the slits, and the extending part of the impervious elastomeric member can be formed with a special shape thereby enhancing the impervious function and also providing a novel appearance to the slide fastener.
8. According to the present invention, the clamped type coupling element can be selected from the individual clamped type coupling element formed through plastic injection molding, the continuous clamped type coupling element formed through molding formation or the individual metal clamped type coupling element, so the present invention can be formed in various status, and the coupling element can be combined with the support tape through several different processing means, so various types of finish products with the impervious function can be provided to satisfy the market requirements.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A clamped type coupling element slide fastener with the structure impervious to fluid, including:

a pair of support tapes, symmetrically arranged at the left and right and respectively formed with a first surface and a second surface;

two rows of coupling elements, respectively clamped at the inner edge of said first surface and said second surface of said pair of said support tapes, said two rows of said coupling elements being enabled to be mutually coupled or separated, wherein at least one of a top surface and a bottom surface each coupling element of said two rows of said coupling elements being formed with a groove; and an impervious elastomeric member, made of a high polymer elastomer, said impervious elastomeric member being filled in said groove of said two rows of said coupling elements when said two rows of said coupling elements being in a coupled status thereby forming a covering layer, and said impervious elastomeric member being filled in a slit between said two rows of said coupling elements and said pair of said support tapes and in a slit formed on another surface of said two rows of said coupling elements thereby respectively forming a slit filling part and an extending part; said covering layer is cut along a center of said two rows of said coupling elements, said slide fastener being able to be coupled or separated;

wherein a top surface of said covering layer of said impervious elastomeric member is not higher than a height of an outer side of said top surface of each said coupling element of said two rows of said coupling elements.

2. The clamped type coupling element slide fastener with the structure impervious to fluid as claimed in claim 1, wherein said coupling element is made of a material selected from a group consisting of a metal and a non-metal material, and selected from the group consisting of POM, polyamide, polyester, acrylonitrile butadiene styrene (ABS), copper, aluminum and, an alloy of zinc and aluminum.

3. The clamped type coupling element slide fastener with the structure impervious to fluid as claimed in claim 2, wherein said coupling element is made of a plastic material, and formed as a molded continuous clamped type coupling element, and each row of said clamped type coupling elements is sewed for being secured at the inner edge of said first surface and said second surface of said pair of said support tapes.

4. The clamped type coupling element slide fastener with the structure impervious to fluid as claimed in claim 2, wherein said coupling elements are formed in up/down unsymmetrical contour and made of a plastic material.

5. The clamped type coupling element slide fastener with the structure impervious to fluid as claimed in claim 1, wherein the location where said groove of each row of said coupling elements being adjacent to the outer side thereof is formed with a concave channel.

6. The clamped type coupling element slide fastener with the structure impervious to fluid as claimed in claim 1, wherein at least a hole is formed at a proper location of each row of said coupling elements, and said impervious elastomeric member is able to be filled in said holes for increasing the combining strength between said impervious elastomeric member and each row of said coupling elements.

7. The clamped type coupling element slide fastener with the structure impervious to fluid as claimed in claim 1, wherein said covering layer of said impervious elastomeric member is covered with a waterproof film made of a high polymer elastic film.

8. The clamped type coupling element slide fastener with the structure impervious to fluid as claimed in claim 1, wherein a surface of said slide fastener is provided with a waterproof film formed through a water repellent agent.

9. The clamped type coupling element slide fastener with the structure impervious to fluid as claimed in claim 1, wherein at least one surface of said pair of said support tapes is provided with a waterproof film made of a high polymer elastic film.

10. A clamped type coupling element slide fastener with the structure impervious to fluid, including:

a pair of support tapes, symmetrically arranged at the left and right and respectively formed with a first surface and a second surface;

two rows of coupling elements, respectively clamped at the inner edge of said first surface and said second surface of said pair of said support tapes, said two rows of said coupling elements being enabled to be mutually coupled or separated, wherein a top surface and a bottom surface of each coupling element of said two rows of said coupling elements being respectively formed with a groove; and an impervious elastomeric member, made of a high polymer elastomer, said impervious elastomeric member being filled in said grooves of said two rows of said coupling elements when said two rows of said coupling elements being in a coupled status thereby respectively forming a covering layer on the top and the bottom surfaces, and said impervious elastomeric member being filled in a slit between said two rows of said coupling elements and said pair of said support tapes thereby forming a slit filling part, and said covering layers on the top and the bottom surfaces and said slit filling part being combined as one piece; said covering layer is cut along a center of said two rows of said coupling elements, said slide fastener is able to be coupled or separated;

wherein a top surface of said covering layer of said impervious elastomeric member is not higher than a height of an outer side of said top surface of each said coupling element of said two rows of said coupling elements.

11. The clamped type coupling element slide fastener with the structure impervious to fluid as claimed in claim 10, wherein said coupling element is made of a material selected from a group consisting of a metal and a non-metal material, and selected the group consisting of from POM, polyamide, polyester, acrylonitrile butadiene styrene (ABS), copper, aluminum and, an alloy of zinc and aluminum.

12. The clamped type coupling element slide fastener with the structure impervious to fluid as claimed in claim 11, wherein said coupling element is made of a plastic material, and formed as a molded continuous clamped type coupling element, and each row of said clamped type coupling elements is sewed for being secured at the inner edge of said first surface and said second surface of said pair of said support tapes.

13. The clamped type coupling element slide fastener with the structure impervious to fluid as claimed in claim 11, wherein said coupling elements are formed in up/down unsymmetrical contour and made of a plastic material.

14. The clamped type coupling element slide fastener with the structure impervious to fluid as claimed in claim 10, wherein the location where said groove of each row of said coupling elements being adjacent to the outer side thereof is formed with a concave channel.

15. The clamped type coupling element slide fastener with the structure impervious to fluid as claimed in claim 10, wherein at least a hole is formed at a proper location of each row of said coupling elements, and said impervious elastomeric member is able to be filled in said holes for increasing the combining strength between said impervious elastomeric member and each row of said coupling elements.

16. The clamped type coupling element slide fastener with the structure impervious to fluid as claimed in claim 10, wherein said covering layer of said impervious elastomeric member is covered with a waterproof film made of a high polymer elastic film.

17. The clamped type coupling element slide fastener with the structure impervious to fluid as claimed in claim 10, wherein a surface of said slide fastener is provided with a waterproof film formed through a water repellent agent.

18. The clamped type coupling element slide fastener with the structure impervious to fluid as claimed in claim 10, wherein at least one surface of said pair of said support tapes is provided with a waterproof film made of a high polymer elastic film.

* * * * *